US009989880B2

(12) United States Patent
Masui et al.

(10) Patent No.: US 9,989,880 B2
(45) Date of Patent: Jun. 5, 2018

(54) IMAGE FORMING APPARATUS AND CARTRIDGE

(71) Applicant: CANON KABUSHIKI KAISHA, Tokyo (JP)

(72) Inventors: Koichiro Masui, Numazu (JP); Nobuyoshi Yoshida, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/074,361

(22) Filed: Mar. 18, 2016

(65) Prior Publication Data

US 2016/0274486 A1 Sep. 22, 2016

(30) Foreign Application Priority Data

Mar. 19, 2015 (JP) ..... 2015-055738
Mar. 20, 2015 (JP) ..... 2015-057118
Feb. 17, 2016 (JP) ..... 2016-027614
Feb. 17, 2016 (JP) ..... 2016-027615

(51) Int. Cl.
*G03G 21/08* (2006.01)
*G03G 15/04* (2006.01)
*G03G 21/18* (2006.01)

(52) U.S. Cl.
CPC ..... *G03G 15/04036* (2013.01); *G03G 21/08* (2013.01); *G03G 21/1803* (2013.01); *G03G 2215/0132* (2013.01)

(58) Field of Classification Search
None
See application file for complete search history.

(56) References Cited

U.S. PATENT DOCUMENTS 4,785,324 A * 11/1988 Yamazaki ..... G03G 21/08 399/128
8,682,220 B2 3/2014 Miyaji
2009/0285588 A1* 11/2009 Furuichi ..... G03G 21/206 399/27
2011/0096452 A1* 4/2011 Miyaji ..... G03G 21/08 361/212

FOREIGN PATENT DOCUMENTS

JP 2001-042715 A 2/2001
JP 2006-243086 A 9/2006
JP 2008-052207 A 3/2008
JP 2010-008973 A 1/2010
JP 2010-160185 A 7/2010
JP 2011-175142 A 9/2011
JP 2013-033091 A 2/2013
JP 2013-156465 A 8/2013
JP 2015158647 A * 9/2015

OTHER PUBLICATIONS

JP 2015158647 English machine translation, Miyaji, Sep. 3, 2015.*

* cited by examiner

*Primary Examiner* — Thomas Giampaolo, II
(74) *Attorney, Agent, or Firm* — Fitzpatrick, Cella, Harper & Scinto

(57) ABSTRACT

An image forming apparatus includes a charging member, a light source, and a light quantity lowering member. The light quantity lowering member is provided so that a lowering amount of a quantity of a part of light reflected by a surface of a member at each of end portions of a charging region where the surface of the image bearing member is charged by the charging member is larger than that at a portion inside an associated end portion with respect to a rotational axis direction of the image bearing member.

16 Claims, 11 Drawing Sheets

| | SURFACE POTENTIAL (V) | | | | | |
|---|---|---|---|---|---|---|
| | -180 | -210 | -240 | -270 | -300 | -330 |
| ABRASION AMOUNT | × | × | △ | △ | ○ | ○ |

(a)

(b)

IMAGE FORMING APPARATUS AND CARTRIDGE

FIELD OF THE INVENTION AND RELATED ART

The present invention relates to an image forming apparatus, such as an electrophotographic copying machine, an electrophotographic printer (e.g., a laser beam printer, an LED printer) or a facsimile machine, for forming an image on a recording material using an electrophotographic type, for example. The present invention also relates to a cartridge to be incorporated in the image forming apparatus.

In an electrophotographic image forming apparatus, from the viewpoint of ozone suppression, as a charging member for electrically charging a photosensitive drum, a charging roller of a contact charging type in which an electroconductive member is contacted to the photosensitive drum to charge the photosensitive drum has been widely used. When the photosensitive drum is charged by this charging roller, electric discharge generates from the charging roller to the photosensitive drum. An amount of the discharge from an end portion of the charging roller with respect to a rotational axis direction of the charging roller to the photosensitive drum is larger than an amount of the discharge from a central portion of the charging roller with respect to the rotational axis direction. This is because, in the neighborhood of the end portion of the charging roller, in addition to the discharge in the neighborhood of a contact portion of the charging roller with the photosensitive drum, the discharge generates from also an end surface of the charging roller.

Here, with an increasing discharge amount, a photosensitive drum surface is liable to abrade. For this reason, with respect to the rotational axis direction of the photosensitive drum, compared with the neighborhood of a central portion, the surface is liable to abrade in the neighborhood of an end portion. When a state in which the photosensitive drum surface is liable to abrade in the neighborhood of a charging roller end portion is continued, a photosensitive layer is locally abraded and a pressure resistance lowers. When charging is made in a state in which the photosensitive layer is locally abraded, a current concentrates at a locally abraded portion and a region where the charging cannot be made generates at a periphery thereof, so that there is a liability that a leak image is generated.

On the other hand, a method in which local abrasion of the photosensitive drum surface generating in the neighborhood of the end portion of the charging roller is suppressed, has been proposed. For example, Japanese Laid-Open Patent Application (JP-A) 2008-52207 employs a constitution in which of discharging light emitted from a pre-exposure device to a photosensitive drum surface, the discharging light emitted to the neighborhood of both end portions of a charging roller is shielded by a shielding member. As a result, a light quantity of the discharging light emitted to the neighborhood of the both end portions of the charging roller lowers, and a potential difference between the charging roller both end portions and the photosensitive drum in the neighborhood thereof becomes small when the photosensitive drum is charged again, so that it becomes possible to suppress the electric discharge.

SUMMARY OF THE INVENTION

The present invention provides a further improvement of the above-described conventional constitution.

According to an aspect of the present invention, there is provided an image forming apparatus for forming an image by transferring a toner image from a rotatable image bearing member onto a transfer receiving material, the image forming apparatus comprising: a charging member for electrically charging the image bearing member; a light source for emitting light with which a surface of the image bearing member is irradiated to remove an electric charge remaining on the surface of the image bearing member after transfer of the toner image, wherein a part of the light is reflected by a surface of a member; and a light quantity lowering member for lowering a quantity of the part of the light reflected toward the image bearing member, wherein the light quantity lowering member is provided so that a lowering amount of the quantity of the part of the light at each of end portions of a charging region where the surface of the image bearing member is charged by the charging member is larger than that at a portion inside an associated end portion with respect to a rotational axis direction of the image bearing member.

According to another aspect of the present invention, there is provided an image forming apparatus comprising: a rotatable image bearing member for carrying a toner image; a charging member for electrically charging the image bearing member; a transfer member for transferring the toner image from the image bearing member onto a transfer receiving member under application of a transfer voltage; a light source for emitting discharging light with which a surface of the image bearing member is irradiated to remove an electric charge remaining on the surface of the image bearing member after transfer of the toner image; and a light quantity lowering member for lowering a light quantity of the discharging light emitted from the light source to the image bearing member, wherein with respect to a rotational axis direction of the image bearing member, a charging region where the surface of the image bearing member is charged is broader than a transfer region where a current flows when a voltage is applied to the transfer member, and wherein with respect to the rotational axis direction of the image bearing member, the light quantity lowering member lowers the discharging light emitted from the light source to a region which includes end portions of the charging region of the surface of the image bearing member and which is inside the charging region and outside the transfer region, and does not lower the discharging light emitted from the direction to a region inside the transfer region.

Further features of the present invention will become apparent from the following description of exemplary embodiments with reference to the attached drawings.

DESCRIPTION OF THE EMBODIMENTS

First Embodiment

<Image Forming Apparatus>

A general structure of an image forming apparatus A according to First Embodiment of the present invention will be described together with an operation during image formation with reference to the drawings.

Figure 1:
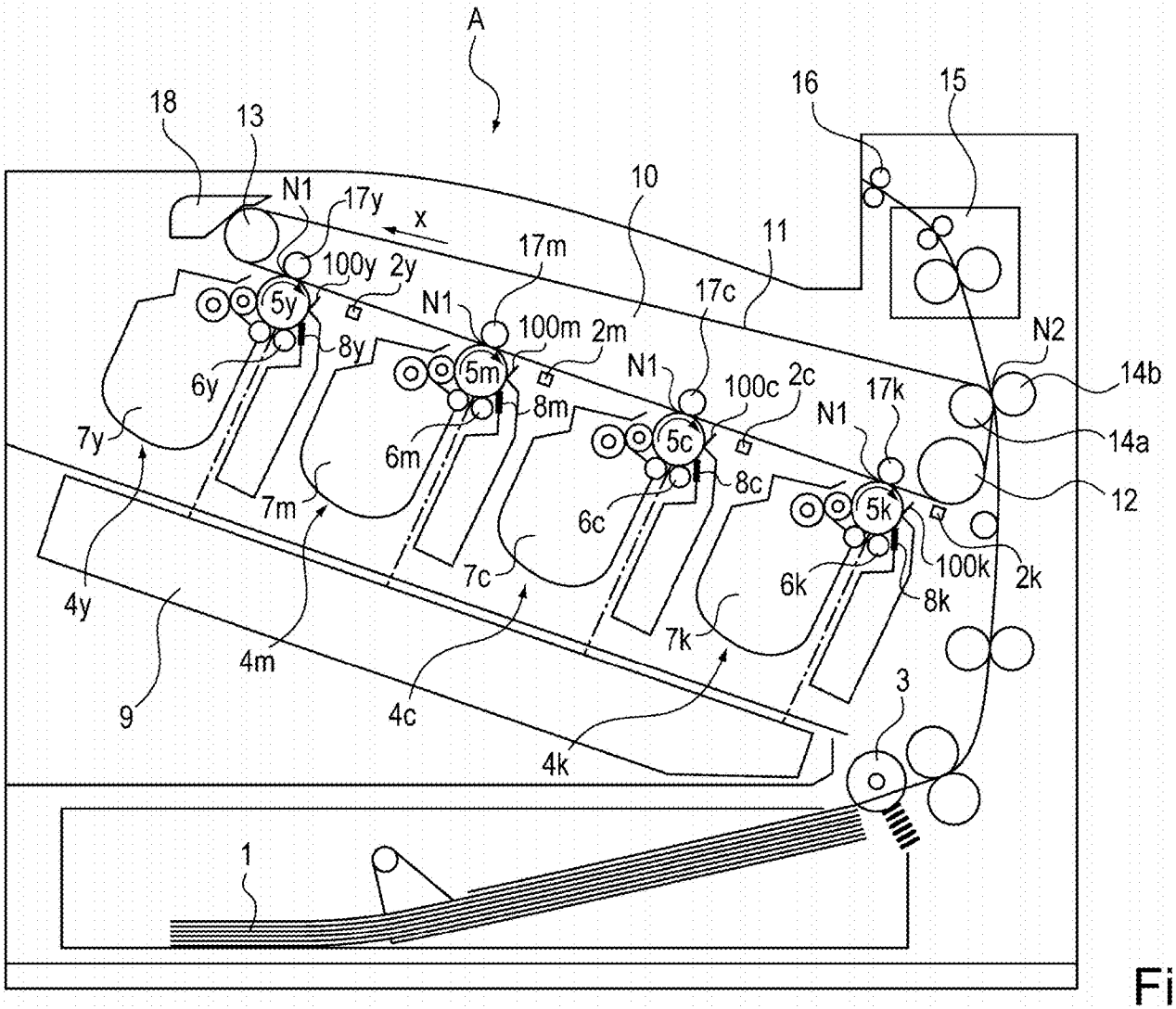
FIG. 1 is a schematic sectional view of an image forming apparatus according to First Embodiment.

The image forming apparatus A according to this embodiment is a full-color laser printer employing a tandem type in which photosensitive drums are arranged in line and employing an intermediary transfer type. As shown in FIG. 1, the image forming apparatus A includes an image forming portion where a toner image is transferred onto a sheet, a feeding portion for supplying (feeding) the sheet to the image forming portion, and a fixing portion for fixing the toner image on the sheet.

The image forming portion includes a process cartridge 4 detachably mountable to a main assembly of the image forming apparatus A, intermediary transfer unit 10, a photosensitive drum (discharging means) 2, and a laser scanner unit 9.

The process cartridge 4 includes process cartridges 4*y*, 4*m*, 4*c*, 4*k*, for colors of yellow, magenta, cyan, black, respectively, which are arranged in line. The process cartridges 4 (4*y*, 4*m*, 4*c*, 4*k*) include organic photoconductor layers (photosensitive layers) and are provided with photosensitive drums (5*y*, 5*m*, 5*c*, 5*k*) as image bearing members. The process cartridges 4 further include charging rollers 6 (6*y*, 6*m*, 6*c*, 6*k*) as charging members for electrically charging the photosensitive drums 5 in contact with the photosensitive drums 5. Further, the process cartridges 4 include developing devices 7 (7*y*, 7*m*, 7*c*, 7*k*) cleaning blades 8 (8*y*, 8*m*, 8*c*, 8*k*) and shielding members 100 (100*y*, 100*m*, 100*c*, 100*k*).

In order to remove residual electric charges on the surfaces of the photosensitive drums 5 in preparation for subsequent image formation after a transfer process, photosensitive drums 2 (2*y*, 2*m*, 2*c*, 2*k*) emit discharging light L from a direction substantially perpendicular to a rotational direction of the photosensitive drums 5 to the surfaces of the photosensitive drums 5.

Each of the shielding members 100 (shielding means) is provided on an optical path of the discharging light L in order to lower a light quantity of the discharging light by regulating an irradiation region of the discharging light L emitted by the pre-exposure device 2. In a shielding region, the discharging light L emitted to both end portions of a charging region Y where the photosensitive drum 5 is electrically charged by the charging roller 6 with respect to a rotational axis direction R of the photosensitive drum 5 is shielded. The shielding member 100 is disposed in the process cartridge 4, so that a distance between the photosensitive drum 5 and the shielding member 100 is decreased and thus shielding accuracy is enhanced.

The intermediary transfer unit 10 includes primary transfer rollers 17 (17*y*, 17*m*, 17*c*, 17*k*) as transfer means, an intermediary transfer belt 11 as an intermediary transfer member, a driving roller 12, a tension roller 13, a secondary transfer opposite roller 14*a* and a cleaning device 18.

The intermediary transfer belt 11 is an endless cylindrical belt and contacts the photosensitive drum 5, and the driving roller 12 receives a rotational force from a driving source such as a motor (not shown), so that the intermediary transfer belt 11 is rotated in a direction of an arrow X shown in FIG. 1. The intermediary transfer belt 11 is stretched by the directing roller 12, the tension roller 13 and the secondary transfer opposite roller 14*a*.

The primary transfer roller 17 is provided opposed to an associated photosensitive drum 5 in contact with the intermediary transfer belt 11 and urges the intermediary transfer belt 11 in a direction of the photosensitive drum 5, thus forming a primary transfer portion N1 where the intermediary transfer belt 11 and the photosensitive drum 5 are in contact with each other.

When a controller (not shown) sends a print signal during image formation, the sheet stacked and accommodated in a sheet stacking portion 1 is sent to the image forming portion by the feeding roller 3.

On the other hand, the surface of the photosensitive drum 5 is electrically charged by the charging roller 6. Then, the laser scanner unit 9 emits laser light from an unshown light source provided inside the laser scanner unit 9, so that the surface of the photosensitive drum 5 is irradiated with the laser light. As a result, an electrostatic latent image is formed on the surface of the photosensitive drum 5. This electrostatic latent image is developed by a developing device 7, so that the toner image is formed on the photosensitive drum 5. The toner image formed on the photosensitive drum 5 of each of the process cartridges 4 is primary-transferred onto the intermediary transfer belt 11 which is a transfer receiving member at a primary transfer portion N1 by applying a transfer bias of an opposite polarity to a charge polarity of a toner to the primary transfer roller 17. Thereafter, the intermediary transfer belt 11 rotates in the arrow X direction shown in FIG. 1, so that the primary-transferred toner image moves to a downstream portion with respect to the rotational direction by rotation of the intermediary transfer belt 11. Thereafter, the toner image reaches a secondary transfer portion formed by the secondary transfer opposite roller 14*a* and a secondary transfer roller 14*b*, where the toner image is transferred onto the sheet.

The sheet on which the toner image is transferred is sent to a fixing device 15 and is heated and pressed, so that the toner image is fixed on the sheet and then is fed by a discharging roller 16 and thus is discharged onto a discharge portion.

After the image formation, the surface of the photosensitive drum 5 is irradiated with the discharging light L emitted from the pre-exposure device 2, so that residual electric charges on the surface of the photosensitive drum 5 are removed (discharged) and then the image forming apparatus prepares for subsequent image formation.

In recent years, downsizing of the image forming apparatus is promoted, and particularly in a tandem type image forming apparatus for forming color images, a pitch between adjacent photosensitive drums is narrowed to the limit. Correspondingly, depending on an arrangement relationship with a member such as the charging roller, in some cases, it was difficult to directly irradiate the photosensitive drum with all of components of the discharging light emitted from the pre-exposure device. For this reason, there is a constitution in which in addition to photosensitive layer (direct component) with which the photosensitive drum is directly irradiated, the photosensitive drum is irradiated with discharging light (reflection component) reflected by a reflection member and thus discharging is sufficiently made.

However, in the constitution in JP-A 2008-52207, the shielding member was provided for the purpose of shielding the direct component. For this reason, in a constitution in which the reflection component was emitted during the discharging, in some cases, the shielding member did not completely shield the reflection component. In this case, there is a liability that the electric discharge in the neighborhood of the charging end portions cannot be completely suppressed during the charging and thus the photosensitive layer is abraded to generate a leak image.

Therefore, in this embodiment, a constitution in which local abrasion of the photosensitive layer of the photosensitive drum in the neighborhood of the charging roller end portions can be prevented with high reliability will be described.

<Pre-Exposure Device and Shielding Member>

Next, a structure of the pre-exposure device 2 and the shielding member 100 in this embodiment will be specifically described with reference to the drawings.

Figure 2:
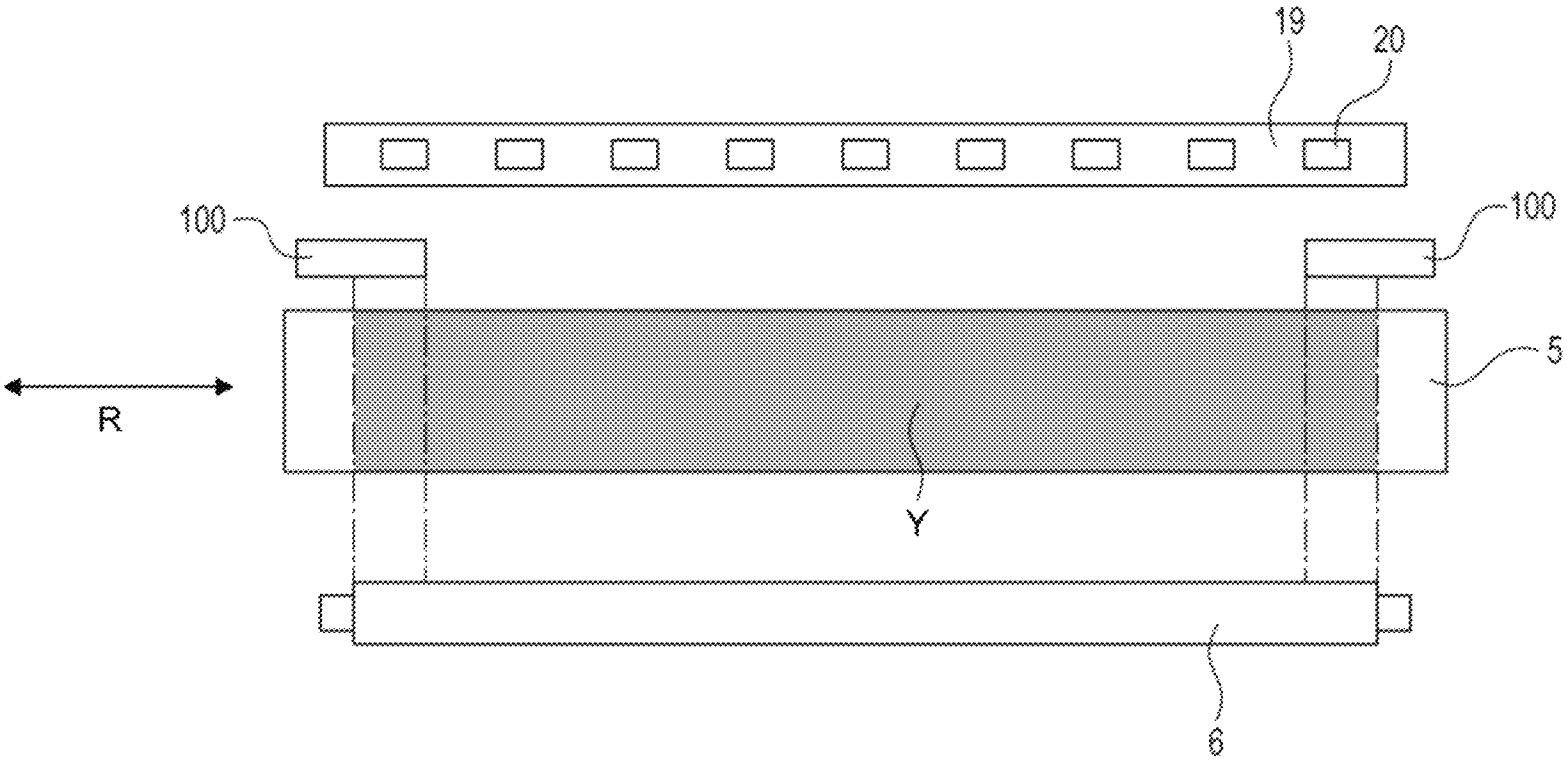
FIG. 2 is a schematic view for illustrating a structure of a pre-exposure device and a shielding member in First Embodiment.

As shown in FIG. 2, the photosensitive drum 2 has a structure in which light sources 20 are provided on a substrate 19 at regular intervals. In this embodiment, as each of the light sources 20, a chip-type LED which is small in driving voltage and which is easy to downsize is used. An interval between adjacent light sources is 28.5 mm. However, the light sources 20 are not limited thereto, but may also employ a type using a light guide or a type using a halogen lamp.

The discharging light L emitted by the pre-exposure device 20 is irradiated from the light sources 20 depending on an illuminating angle and light intensity while being radially diffused. Here, of the discharging light L, light with which the photosensitive drum 5 is directly irradiated is the direct component, and light which is reflected by the intermediary transfer belt 11 and with which the photosensitive drum 5 is irradiated is the reflection component.

In this embodiment, a surface layer of the intermediary transfer belt 11 is a surface layer obtained by coating a coating liquid containing a radiation-curable monomer or oligomer component and then by irradiating the intermediary transfer belt 11 with energy rays to cure the coating liquid. An optical reflectance is about 80%.

Next, a structure of the shielding member 100 will be described. The shielding member 100 may desirably be a member which does not permit light transmission since the shielding member 100 is used as a member for shielding the discharging light L emitted from the pre-exposure device 2. However, as described later, there is no need to completely shield the discharging light L with which both end portions of the charging region Y are irradiated, and it is only required that a constitution in which a light quantity is lowered to a predetermined value or less is employed. That is, the shielding member 100 is a light quantity lowering member for lowering the light quantity of the discharging light L emitted from the light sources 20 to the photosensitive drum 5.

In this embodiment, the charging roller 6 for charging the photosensitive drum 5 in contact with the photosensitive drum 5 is used, and therefore the both end portions of the charging region Y referred to herein means both end portions of a contact region of the photosensitive drum 5 with the charging roller 6 with respect to the rotational axis direction R of the photosensitive drum 5.

Further, with respect to a position where the shielding member 10 is provided, first, in order to shield the direct component of the discharging light L, the shielding member 100 is provided between each of the end portions of the charging region Y and a center of an associated light source 20 with which the end portion is irradiated with the discharging light L. As a result, of the discharging light L, at least the direct component is shielded, so that the light quantity can be lowered. That is, with respect to the rotational axis direction of the photosensitive drum 5, the shielding member 100 is provided only at a position opposing the associated end portion of the charging region Y.

Further, in order to shield the reflection component of the discharging light L, the shielding member 100 is provided so as to project toward the intermediary transfer belt 11 (reflection means) with respect to a tangential line V passing through a center of the light source 20 for the discharging light L and the surface of the photosensitive drum 5. The light source 20 referred to herein means the light source 20 with which the associated end portion of the charging region Y is irradiated. Of the discharging light L, the reflection component has an optical path on the intermediary transfer belt 11 side with respect to the tangential line passing through the center of the light source 20 and the surface of the photosensitive drum 5. Accordingly, by employing such a constitution, at least a part of the reflection component is shielded, so that the light quantity can be lowered.

Depending on a relationship of the pitch between adjacent light sources 20, in some cases, there is no end portion of the charging region Y on the tangential line V passing through the center of the light source 20 and the surface of the photosensitive drum 5. In this case, even in the case where the reflection component does not completely cross the tangential line V, the shielding members 100 are provided so as to project toward the intermediary transfer belt 11 with respect to a contact flat plane including all of the tangential lines V. As a result, the reflection component of the discharging light L with which the end portions of the charging region Y are irradiated can be shielded. In this case, the tangential line V can be regarded as a plane including the contact flat plane.

Figures 3, 4:
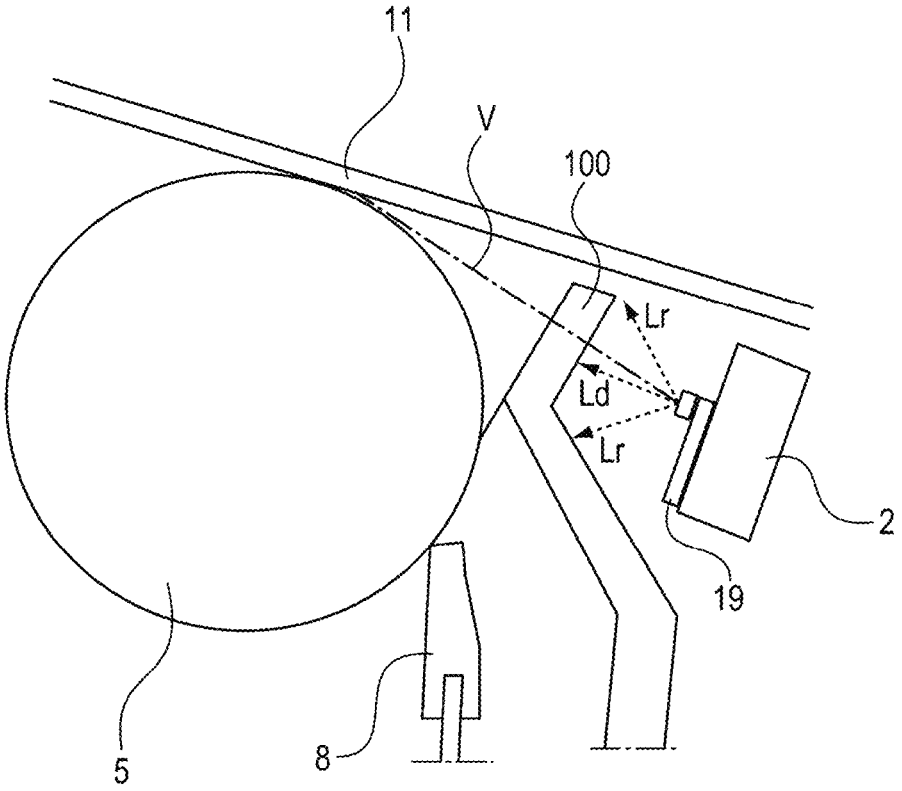
FIG. 3 is a schematic sectional view for illustrating the structure of the shielding member in First Embodiment.
FIG. 4 is a table showing a relationship between a surface potential immediately before charging and an abrasion amount of a photosensitive layer after the charging, at each of both end portions of a charging region of a photosensitive drum.

The above constitution will be further described citing an example. As shown in FIG. 3, of the direct component of the discharging light L, light emitted perpendicularly from the light source 20 is direct light Ld, and of the reflection component of the discharging light L, light having half-width intensity when light intensity of the direct light Ld is 100% is reflected light Lr, and the shielding member 100 provided at an upper portion of a frame is disposed so as to project toward the intermediary transfer belt 11 with respect to the tangential line V passing through the center of the light source 20 and the surface of the photosensitive drum 5.

As a result, it becomes possible to shield both of the direct light Ld which is the direct component of the discharging light L and the reflected light Lr which is the reflection component of the discharging light L. For this reason, during the charging, a potential difference between both end portions of the charging roller 6 and both end portions of the charging region Y becomes small, so that the electric discharge can be suppressed. Accordingly, compared with a constitution for the purpose of only shielding the direct component, local abrasion of the photosensitive layer at the both end portions of the charging region Y is prevented with reliability, so that generation of the leak image can be prevented.

Figure 13:
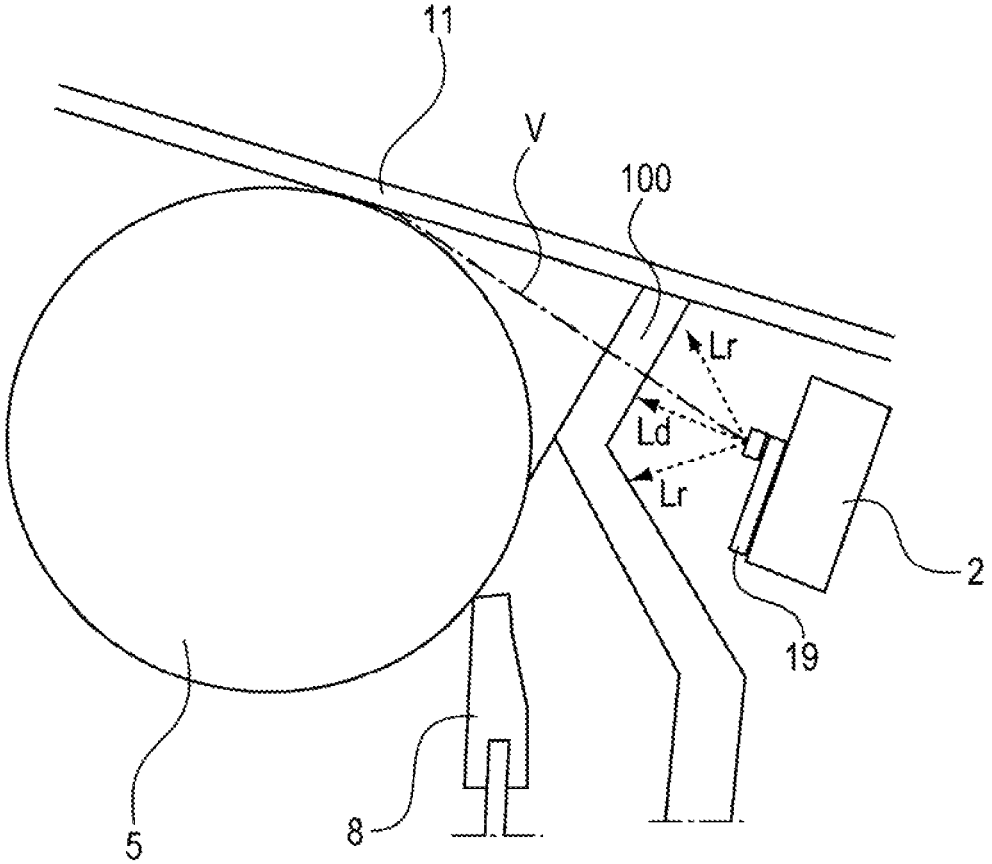
FIG. 13 is a schematic sectional view for illustrating the structure of a modification of the shielding member.

In this embodiment, a space was provided between the shielding member 100 and the intermediary transfer belt 11. However, a constitution in which the shielding member 100 and the intermediary transfer belt 11 are in contact with each other may also be employed, as shown in FIG. 13. As a result, the reflection component can be shielded to a larger degree, so that the light quantity of the discharging light L can be further lowered.

The shielding member 100 may preferably be a flexible member. As a result, when the shielding member 100 is provided in contact with the intermediary transfer belt 11, it is possible to prevent flexure (bending) of the intermediary transfer belt 11. At the same time, it is possible to prevent the shielding member 100 from being urged in a rotational direction of the intermediary transfer belt 11 to be broken.

The shielding member 100 is not necessarily required to have a constitution in which the shielding member 100 completely shields the discharging light L with which the both end portions of the charging region Y is irradiated. That is, as described below, a constitution in which a potential difference between the charging roller 6 and the photosensitive drum 5 at each of the both end portions of the charging region Y is a predetermined value or less during the charging may only be required to be employed.

For example, FIG. 4 is a table showing a relationship between a surface potential (ordinate) immediately before the charging and an abrasion amount (abscissa) of the photosensitive layer after the charging. In this embodiment, the surface potential of the photosensitive drum 5 immediately after the charging is uniformly −600 V. Further, with respect to the abrasion amount, when the abrasion amount of the photosensitive drum 5 in a region other than the both end portions of the charging region Y is 100%, "○" represents the abrasion amount of 100% or less, "Δ" represents the abrasion amount of more than 100% and not more than 110%, and "x" represents the abrasion amount of more than 110%, in which the photosensitive layer at the both end portions of the charging region Y was abraded.

As shown in the table of FIG. 4, the abrasion amount of the photosensitive layer at the both end portions of the charging region Y was more than that in a region other than the both end portions of the charging region Y by 10% or more when the surface potential of the photosensitive drum 5 at the both end portions of the charging region Y immediately before the charging is −180 V. On the other hand, the abrasion amount of the photosensitive layer at the both end portions of the charging region Y was similar to that in the region other than the both end portions of the charging region Y when the surface potential of the photosensitive drum 5 at the both end portions of the charging region Y immediately before the charging is −300 V. Accordingly, it is understood that when the surface potential of the photosensitive drum 5 at the both end portions of the charging region y immediately before the charging is −300 V, it becomes possible to prevent the local abrasion of the photosensitive layer.

This means the following. That is, the surface potential of the photosensitive drum 5 immediately after the charging is taken as 100%, and the surface potential in a region where the electrostatic latent image is formed by irradiation with the laser light by the laser scanner unit 9 after the charging is taken as 0%. In this case, the local abrasion of the photosensitive layer can be prevented by shielding the discharging light L by the shielding member 100 so that the surface potential of the photosensitive drum 5 at the both end portions of the charging region Y immediately before the charging (after the irradiation with the discharging light L) is 50% or more. Incidentally, a constitution in which the reflected light Lr with which a portion of the photosensitive drum 5 inside the both end portions of the charging region Y is partly shielded may also be employed. In this case, by the shielding, it is only required that a lowering amount of a light quantity of the reflected light Lr with which the photosensitive drum 5 is irradiated is larger at each of the both end portions of the charging region Y than at the portion inside the both end portions of the charging region Y. This is also true for the direct light Ld; a constitution in which the shielding member 100 partly shields the direct light Ld of the discharging light L with which the photosensitive drum 5 is irradiated at the portion inside the both end portions of the charging region Y may also be employed. In this case, by the shielding, it is only required that a lowering amount of a light quantity of the direct light Ld with which the photosensitive drum 5 is irradiated is larger at each of the both end portions of the charging region Y than at the portion inside the both end portions of the charging region Y.

<Modified Embodiment>

Next, as a modified embodiment of this embodiment, a constitution in which a shielding member 100 is bent at a position on an intermediary transfer belt 11 side with respect to the tangential line passing through the center of the light source and the surface of the photosensitive drum 5 will be described.

Figure 5:
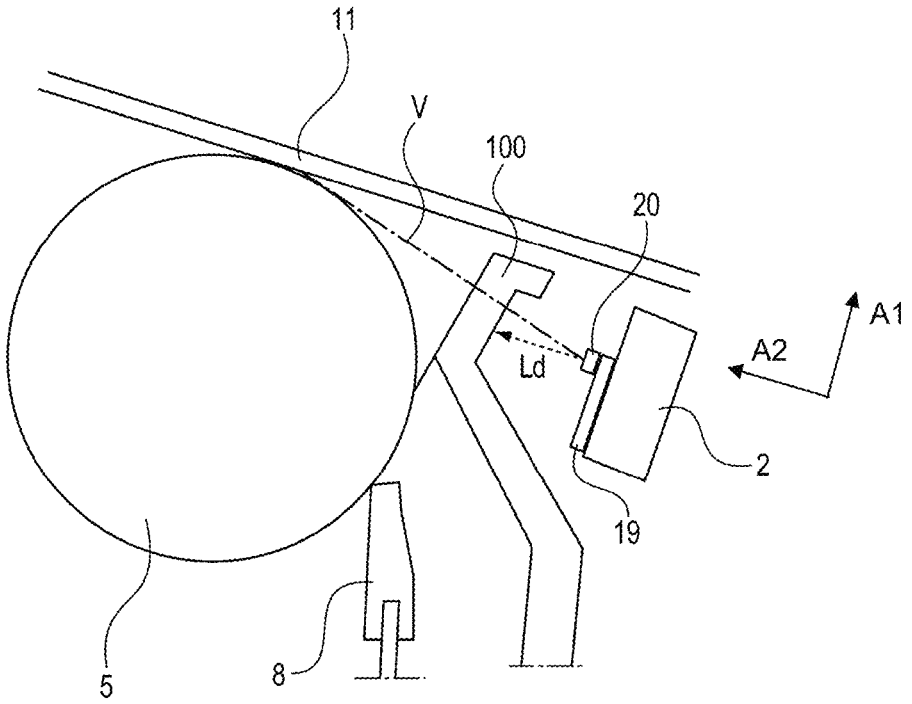
In FIG. 5, (a) and (b) are schematic sectional views for illustrating a structure of a shielding member in modified embodiment of First Embodiment.
Figure 5:
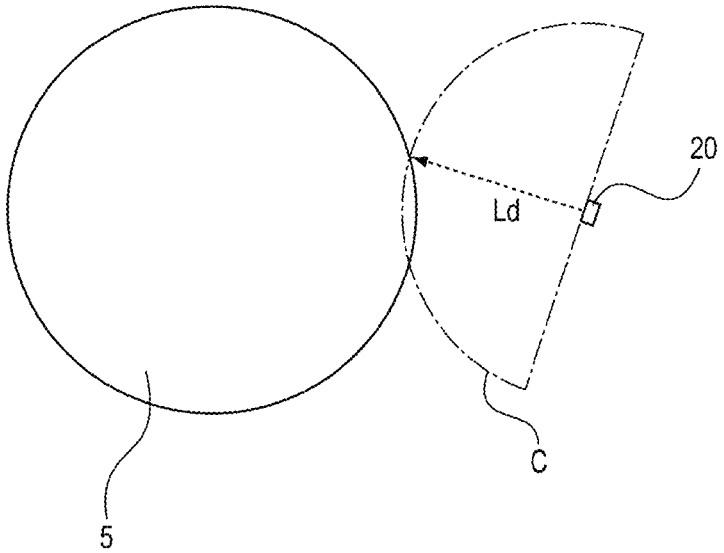

The shielding member 100 in the modified embodiment has a constitution, as shown in (a) of FIG. 5, in which the shielding member 100 is bent in an L-shape or a T-shape on the intermediary transfer belt 11 side with respect to the tangential line passing through the center of the light source 20 to the surface of the photosensitive drum 5. In a bending direction, the shielding member 100 is bent in the same direction as an optical path direction of the discharging light L from the light source 20 toward the end portions of the charging region Y.

Here, the optical path direction of the discharging light L from the light source 20 toward the end portions of the charging region Y refers to an optical path direction of the discharging light L including both of the reflection component and the direct component. With respect to the reflection component, an optical path direction of the reflection component after the discharging light L is reflected by the intermediary transfer belt 11 is included.

That is, as shown in (b) of FIG. 5, of the direct component of the discharging light L, light perpendicularly emitted from the light source 20 is the direct light Ld, and a semicircle of a circle having the direct light Ld as a radius with the light source 20 as a center thereof is taken as a semicircle C. At this time, a direction from the light source 20 toward an arc of the semicircle C, i.e., a radial direction (excluding a direction perpendicular to the direct light Ld) of the semicircle C is a direction capable of constituting the optical path direction of the discharging light L. Particularly, in this embodiment, the intermediary transfer belt 11 forming the reflection component is positioned above the light source 20, and therefore, an upper-half radial direction of the semicircle C with the direct light Ld as a boundary is the optical path direction of the direct component or the reflection component before the reflection. Further, a lower-half radial direction of the semicircle C is the optical path direction of the direct component or the reflection component after the reflection.

By this constitution, when the shielding member 100 is bent toward the light source 20 in the optical path direction, a distance between the light source 20 and the shielding member 100 is decreased, so that a shielding efficiency of the reflection component is increased. Further, when the shielding member 100 is bent in the optical path direction on a side spaced away from the light source 20, a distance between the shielding member 100 and the end portions of the charging region Y is decreased, so that the shielding efficiency of the reflection component is increased.

On the intermediary transfer belt 11 side with respect to the tangential line V passing through the center of the light source 20 and the surface of the photosensitive drum 5, a constitution in which the shielding member is bent in a direction parallel to an illuminating direction of the discharging light L may preferably be employed. As a result, the shielding efficiency is further increased. The illuminating direction refers to the optical path direction of the direct light Ld, of the direct component of the discharging light L, emitted perpendicularly from the light source 20. That is, as shown in (a) of FIG. 5, the shielding member 100 may preferably have such a shape that when viewed from the rotational axis direction R of the photosensitive drum 5, a portion closer to the intermediary transfer belt 11 with respect to an A1 direction perpendicular to the direct light Ld is closer to the light source 20 with respect to an A2 direction parallel to the direct light Ld. By this constitution, the shielding efficiency of the reflection component is increased. Alternatively, the shielding member 100 may preferably have such a shape that when viewed from the rotational axis direction R of the photosensitive drum 5, the portion closer to the intermediary transfer belt 11 with respect to an A1 direction perpendicular to the direct light Ld is remoter from the light source 20 with respect to the A2 direction parallel to the direct light Ld. By this constitution, the shielding efficiency of the reflection component is increased.

<Experimental Result>

A result of a comparison experiment of an abrasion amount of the photosensitive layer with respect to the rotational axis direction R of the photosensitive drum 5 when intermittent printing is effected will be described. In this embodiment, a constitution in which the shielding member 100 is provided so as to project toward the intermediary transfer belt 11 with respect to the tangential line V passing through the center of the light source 20 and the surface of the photosensitive drum 5 is "EMB. 1" (this embodiment). In the constitution of "EMB. 1", a constitution in which the shielding member 100 is bent on the intermediary transfer belt 11 side with respect to the tangential line V is "MOD. EMB." (modified embodiment). Further, a constitution in which the shielding member 100 is provided so as to shield only the direct component of the discharging light L is "COMP. EX." (Comparison Example).

The experiment was conducted, in an experimental environment of 15.0° C. and 10% RH, after the image forming apparatus was left standing for one day and was adapted to the environment. In the experiment, a lateral line recording image of 2% in image ratio was intermittently formed every two sheets and was printed on 1000 sheets. The abrasion amount of the photosensitive layer was calculated from a difference between a surface layer thickness of the photosensitive layer at an initial stage of the experiment and that after the printing of 1000 sheets.

Figure 6:
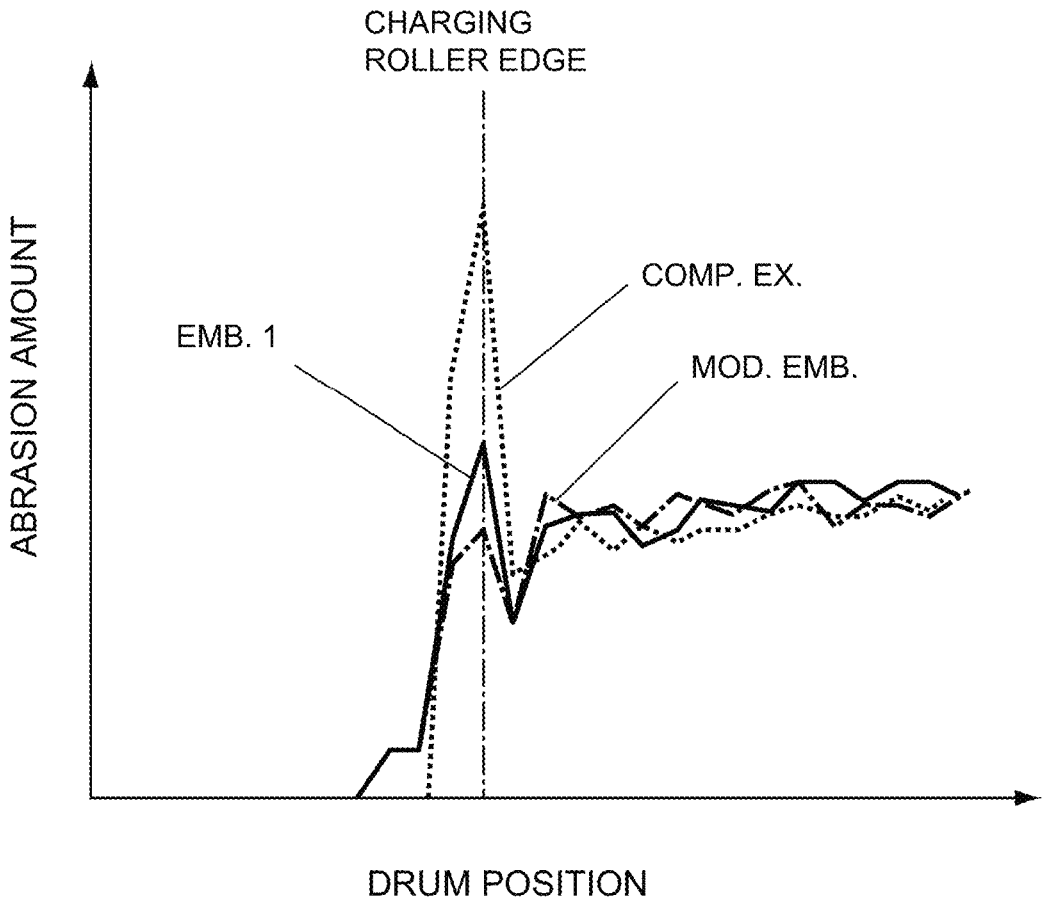
FIG. 6 is a graph showing an experimental result of the abrasion amount when the image forming apparatus effects interruption printing.

As a result, as shown in FIG. 6, in the constitution of "COMP. EX.", the photosensitive layer was largely abraded at the end portions of the charging region Y, so that local abrasion of the photosensitive layer with respect to the rotational axis direction R of the photosensitive drum 5 generated. This is because of the discharging light L, only the direct component is shielded by the shielding member 100 and therefore the end portions of the charging region Y are irradiated with the reflection component and thus the electric discharge is not completely suppressed during the charging.

On the other hand, in the constitution in "EMB. 1" (this embodiment), the abrasion amount of the photosensitive layer at the end portions of the charging region Y was suppressed so that the local abrasion of the photosensitive layer with respect to the rotational axis direction R of the photosensitive drum 5 was eliminated. This is because of the discharging light L, not only the direct component but also the reflection component are shielded by the shielding member 100, and therefore the potential difference between the both end portions of the charging roller 6 and the end portions of the charging region Y becomes small and thus the electric discharge is suppressed.

In the constitution in "MOD. EMB." (modified embodiment), the abrasion amount of the photosensitive layer at the end portions of the charging region Y was further suppressed. This is because the shielding member 100 shields not only the direct component but also the reflection component of the discharging light L and the shielding efficiency is high.

From the above experimental result, it was confirmed that the local abrasion of the photosensitive layer at the end portions of the charging region Y can be suppressed by the constitution in this embodiment. Accordingly, it was confirmed that generation of the leak image can be prevented with high reliability by the constitution in this embodiment.

In this embodiment, the pre-exposure device 2 was provided in the main assembly of the image forming apparatus A, but the present invention is not limited thereto. A constitution in which the pre-exposure device 2 is provided in the process cartridge 4 may also be employed. The position of the shielding member 100 is determined by a relative positional relationship with the position of the pre-exposure device 2, and therefore by providing the shielding member 100 and the pre-exposure device 2 in the process cartridge 4, the shielding region of the discharging light L is easily regulated.

In this embodiment, the intermediary transfer type image forming apparatus capable of forming the color image was described, but the present invention is not limited thereto. The present invention is also applicable to an image forming apparatus capable of forming a monochromatic image. In this case, as a reflecting member for reflecting the discharging light L, the sheet or the transfer roller would be considered. Other than these members, a constitution in which a reflecting member is separately provided may also be employed.

The image forming apparatus A may also be a printer, a copying machine, a facsimile machine or a multi-function machine having a combination of functions of these machines. Further, the image forming apparatus A may also be an image forming apparatus in which a recording material carrying member is provided and toner images of respective colors are successively transferred superposedly onto a recording material carried on the recording material carrying member.

By the above-described constitution in this embodiment, the light quantity of both of the direct component and the reflection component of the discharging light with which the both end portions of the charging region, where the photosensitive drum is charged by the charging roller, with respect to the rotational axis direction R are irradiated lowers. Accordingly, the potential difference between the both end portions of the charging roller and the both end portions of the charging region becomes small during the charging, so that the electric discharge can be suppressed with high reliability. Accordingly, local abrasion of the photosensitive layer at the both end portions of the charging region of the photosensitive drum can be prevented with high reliability, so that generation of the leak image can be prevented.

Second Embodiment

<Image Forming Apparatus>

An image forming apparatus in this embodiment is similar to the image forming apparatus A in First Embodiment, and therefore will be omitted from description.

<ATVC Control>

ATVC (active transfer voltage control) carried out during primary transfer in this embodiment will be described.

In the ATVC, first, during non-image formation, voltages subjected to constant-voltage control by controlling a transfer voltage source (voltage applying means) are applied to each of the primary transfer rollers 17 while changing an output voltage value. Then, from values of currents flowing at that time, resistance values of the primary transfer roller 17 and the intermediary transfer belt 11 are measured, and then a proper transfer voltage depending on the resistance value is applied to the primary transfer roller 17 when the toner image is transferred onto the sheet.

Figure 7:
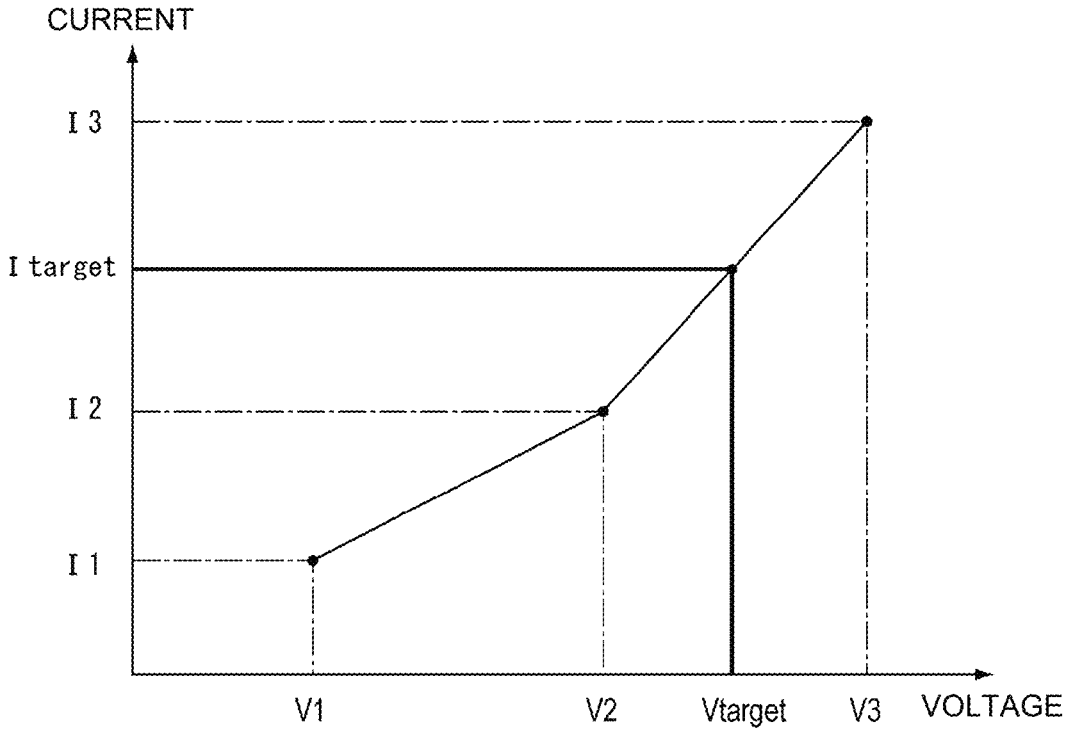
FIG. 7 is a graph for illustrating a control method of a transfer voltage in Second Embodiment.

Specifically, first, the photosensitive drum 5 is charged by the charging roller 6 and thereafter as shown in FIG. 7, a plurality of species of voltages (V1, V2, V3) are applied to the primary transfer roller 17, so that currents are caused to flow toward the photosensitive drum 5. At this time, current values (I1, I2, I2) corresponding to these voltage values (V1, V2, V3) are detected by an unshown current value sensor (current value detecting means). Then, from a detection result of these values, a target transfer voltage Vtarget (proper value) corresponding to a target transfer current Itarget is calculated and is set at a transfer voltage for the primary transfer roller 17.

The transfer voltage is set by the ATVC at timing immediately before the image formation in order to meet a durability fluctuation in and environment fluctuation in resistance value of the primary transfer rollers 17 and the intermediary transfer belt 11. The setting of the transfer voltage may be made independently for each of the colors or made at the primary transfer portion for a certain one color.

In this embodiment, the transfer voltage value applied to the primary transfer roller 17 was described, but in the ATVC, it is also possible to set a transfer voltage value applied to the secondary transfer roller 14*b*. It is also possible to set a transfer voltage value for not only the image forming apparatus of the intermediary transfer type but also an image forming apparatus having a constitution in which the toner image is directly transferred onto the sheet at a transfer nip formed by the photosensitive drum and a transfer roller.

However, in the case where the ATVC is effected, in the constitution of JP-A 2008-52207, a current flowing toward the photosensitive drum is not stabilized and the ATVC with high accuracy cannot be executed in some cases. This is because JP-A 2008-52207 aims at preventing the local abrasion of the photosensitive layer in the neighborhood of the charging roller and therefore a region (transfer region) where the current flows in the rotational axis direction of the photosensitive drum when the voltage is applied to the primary transfer roller is not taken into consideration. Accordingly, a potential difference can generate in the transfer region for the reason described below.

The reason why the potential difference generates in the transfer region after the charging is as follows. That is, the electric discharge is suppressed in a region where the discharging light is not emitted by the shielding member in the neighborhood of the both end portions of the charging region. On the other hand, the electric discharge is made in another region. Accordingly, a region where the discharging light is shielded is, compared with a region where the discharging light is emitted, in a state in which a degree of the abrasion of the photosensitive drum surface is small. When the image formation is continued in a state in which there is a difference in this abrasion amount, a difference in film thickness of the photosensitive layer gradually increases, so that when the photosensitive drum is charged in a state in which the film thickness difference is large, a potential difference depending on the film thickness difference generates. Particularly, at a stage of an end of a lifetime of the photosensitive drum, the state in which the film thickness difference is large is formed, so that this difference is further conspicuous for the photosensitive drum having an extended lifetime. For this reason, in the case where a region irradiated with the discharging light and a region where the discharging light is shielded co-exist in the transfer region, the film thickness difference generates between these regions, so that the potential difference generates in the surface potential after the charging.

Therefore, in this embodiment, a constitution in which local abrasion of the photosensitive layer of the photosensitive drum in the neighborhood of the charging roller end portions can be prevented and the ATVC can be carried out will be described.

<Pre-Exposure Device and Shielding Member>

Next, a structure of the pre-exposure device 2 and the shielding member 100 in this embodiment will be specifically described with reference to the drawings.

Figure 8:
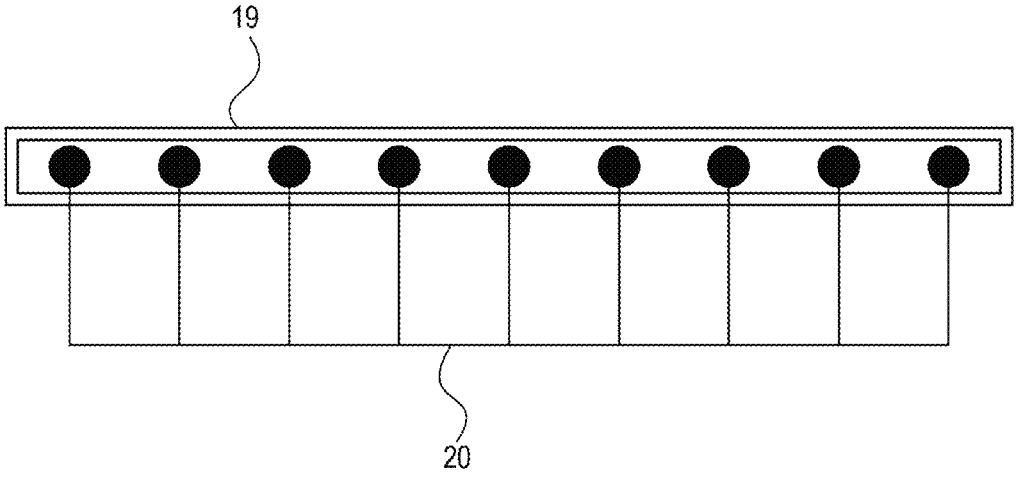
FIG. 8 is a schematic view for illustrating a structure of a pre-exposure device in Second Embodiment.

As shown in FIG. 8, the photosensitive drum 2 has a structure in which light sources 20 are provided on a substrate 19 at regular intervals. In this embodiment, as each of the light sources 20, a chip-type LED which is small in driving voltage and which is easy to downsize is used. An interval between adjacent light sources is 28.5 mm. However, the light sources 20 are not limited thereto, but may also employ a type using a light guide or a type using a halogen lamp.

Figure 9:
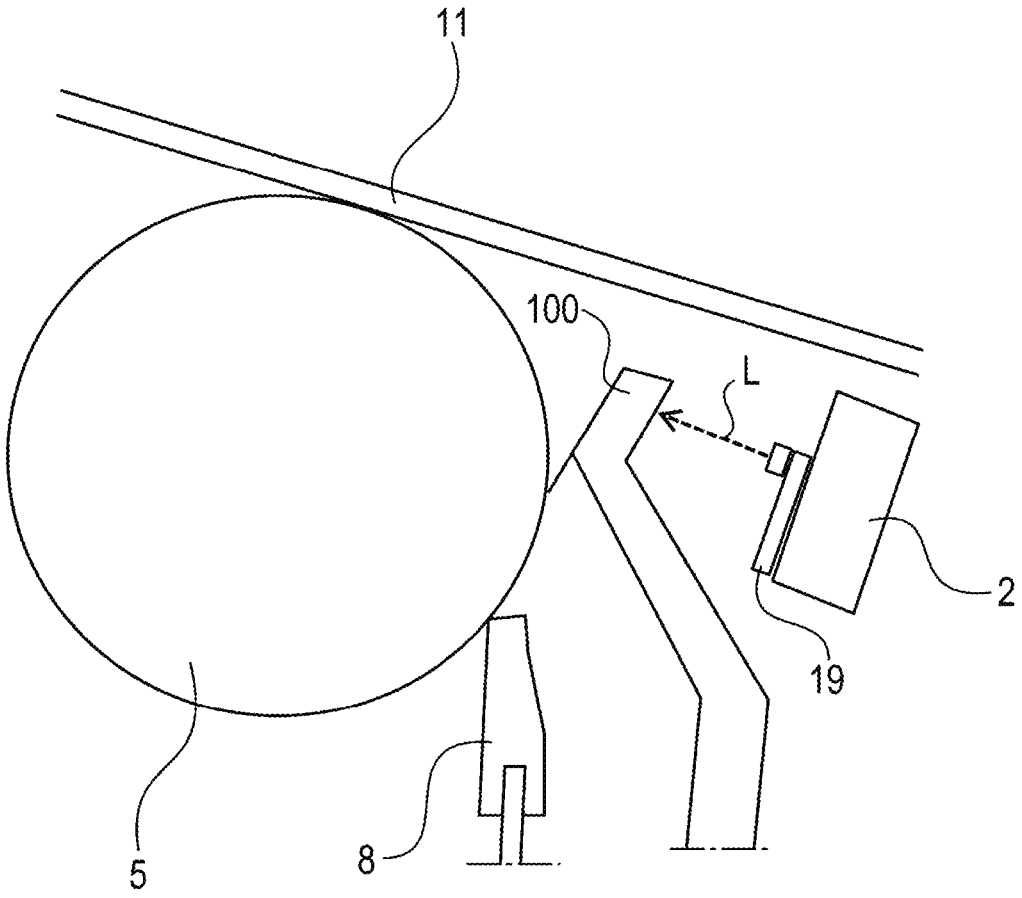
FIG. 9 is a schematic view for illustrating a structure of a shielding member in Second Embodiment.

The shielding member 100 is, as shown in FIG. 9, provided on an optical path of the discharging light L in order to regulate an illumination region of the discharging light L emitted by the pre-exposure device 2. The shielding member 100 is provided in the process cartridge 4, so that a distance between the photosensitive drum 5 and the shielding member 100 decreases, so that shielding accuracy is further enhanced.

The shielding member 100 is provided inside the charging region including the both end portions of the charging region with respect to the rotational axis direction of the photosensitive drum 5 so as to lower the light quantity by shielding the discharging light L emitted to an outside of the transfer region. In the following, description will be specifically described with the reason therefor.

Figure 10:
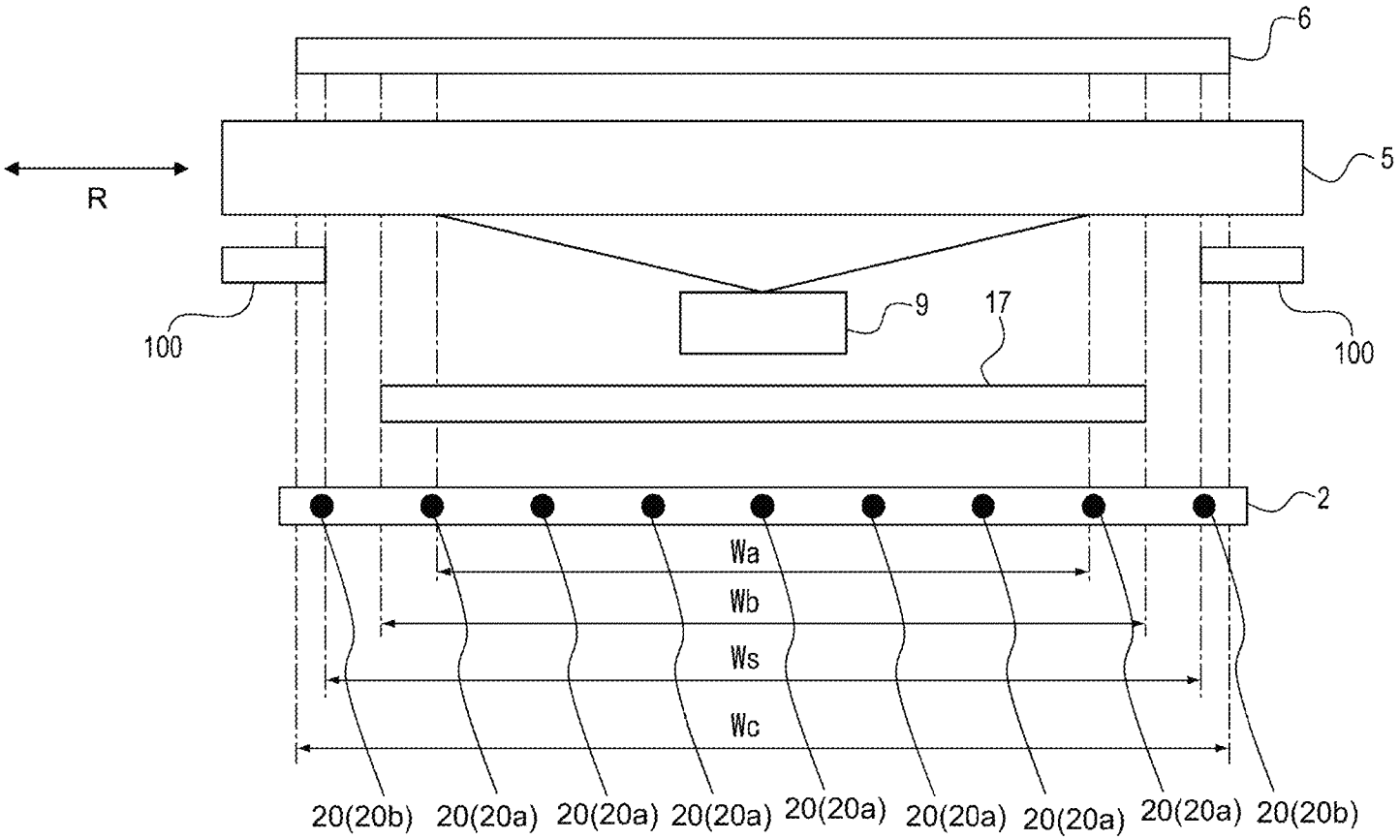
FIG. 10 is a schematic view for illustrating a region where discharging light is shielded by a shielding member in Second Embodiment.

First, as shown in FIG. 10, an exposure region where the photosensitive drum 5 is exposed to light by the laser scanner unit 9 is Wa. Further, with respect to the rotational axis direction R of the photosensitive drum 5, a transfer region where the current flows when the voltage is applied to the primary transfer roller 17 is Wb. A charging region where the photosensitive drum 5 is charged by the charging roller 6 with respect to the rotational axis direction R of the photosensitive drum 5 is Wc. Further, an illuminating region where the surface of the photosensitive drum 5 is irradiated with the discharging light L is Ws. Of a plurality of light sources 20, the light sources overlapping with the transfer region Wb at positions with respect to the rotational axis direction R are first light sources 20*a*, and the light sources which do not overlap with the transfer region (i.e., overlapping with regions outside the transfer region Wb) are second light sources 20*b*.

In this case, a relationship of Wa<Wb holds. That is, the transfer region is broader than the exposure region where the photosensitive drum 5 is exposed to light by the laser scanner unit 9. This is because the exposure region is an image forming region and therefore the transfer region where the toner image is transferred is required to be at least not less than the image forming region.

Further, a relationship of Wb<Wc holds. This is because in order to shield, by the shielding member 100, the discharging light L emitted to the inside of the charging region and the outside of the transfer region with respect to the rotational axis direction R of the photosensitive drum 5, there is a need that the charging region is broader than the transfer region.

Here, with respect to the illuminating region Ws irradiated with the discharging light L, the shielding member 100 is provided so that a relationship of Wb<Ws<Wc holds. With respect to the rotational axis direction R, the illuminating region Ws corresponds to a distance between inner ends of the shielding members 100. That is, with respect to the rotational axis direction R of the photosensitive drum 5, the shielding members 100 are provided so as to shield the discharging light L emitted to the inside of the charging region and the outside of the transfer region. At this time, particularly, the shielding members 100 are provided so as to shield the discharging light L with which the both end portions of the charging region with respect to the rotational axis direction R of the photosensitive drum 5 is irradiated. That is, the shielding members 100 are disposed only at positions opposing regions inside the charging region Wc including the both end portions of the charging region Wc and outside the transfer regions Wb with respect to the rotational axis direction R of the photosensitive drum 5. Further, the shielding members 100 are disposed at non-overlapping regions with the first light sources 20*a*. In addition, the shielding members 100 are disposed at positions where the shielding members 100 at least partly overlap with the second light sources 20*b* with respect to the rotational axis direction R.

By such a constitution, the discharging light L is not shielded in the transfer region, and therefore the electric discharge is made uniformly in the transfer region, so that the potential difference does not generate in the transfer region immediately before the charging. Accordingly, there is no difference in discharge amount in the transfer region during the charging, so that there is no difference in abrasion amount of the surface of the photosensitive drum 5. For this reason, even in the case where the photosensitive layer is abraded by long-term use, the photosensitive layer is uniformly abraded in the transfer region, and therefore the potential difference does not generate in the transfer region after the charging. Accordingly, when the ATVC is effected, the potential difference does not generate in the transfer region, and therefore it is possible to effect the ATVC with high accuracy.

Further, the discharging light L emitted to the neighborhood of the both end portions of the charging roller 6 is shielded, and therefore the potential difference between the both end portions of the charging roller 6 and the photosensitive drum 6 at a periphery thereof becomes small during the charging, so that the electric discharge can be suppressed. Accordingly, it is possible to prevent local abrasion of the photosensitive layer of the photosensitive drum 5 in the neighborhood of the both end portions of the charging roller 6, so that it is possible to prevent generation of the leak image.

The shielding member 100 not only includes a member for completely shielding the discharging light but also includes a member for lowering the light quantity of the discharging light L. That is, the shielding member 100 may only be required to achieve an effect of suppressing a discharge amount by decreasing the potential difference between both end portions of the charging roller 6 and the photosensitive drum 5 at a periphery thereof during the charging. That is, the shielding member 100 is a light quantity lowering member for lowering the quantity of the light emitted from the light source 20 to the photosensitive drum 5.

Further, the image forming apparatus A uses the charging roller 6 of the contact type and the primary transfer rollers 17, and therefore the charging region means a region where the charging roller 6 and the photosensitive drum 5 are in contact with each other. Further, the transfer region means a region where the photosensitive drum 5 opposing the primary transfer 17 contacts the intermediary transfer belt 11.

<Experimental Result>

Figure 11:
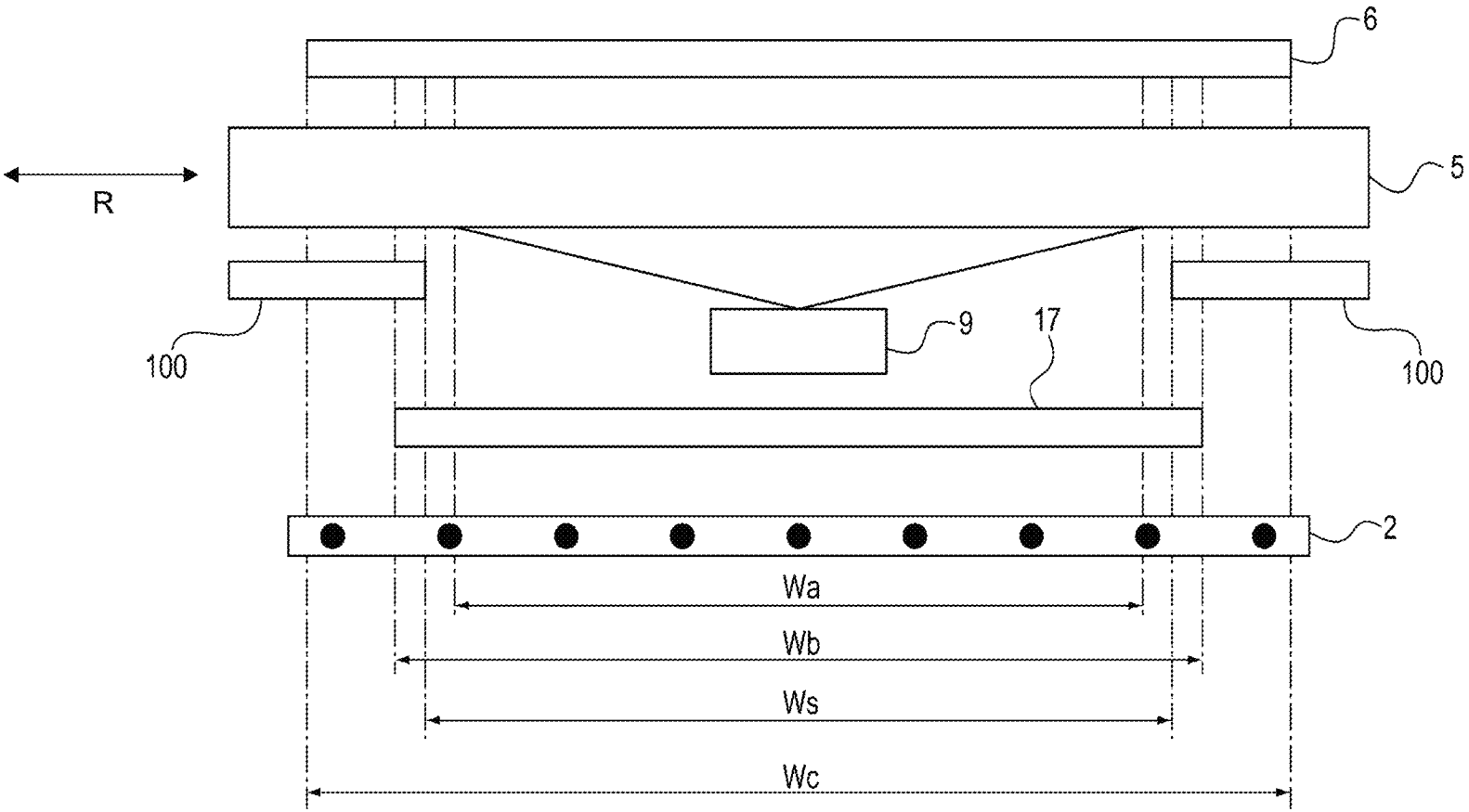
FIG. 11 is a schematic view for illustrating a region where discharging light is shielded by a shielding member in Comparison Example 2.
Figure 12:
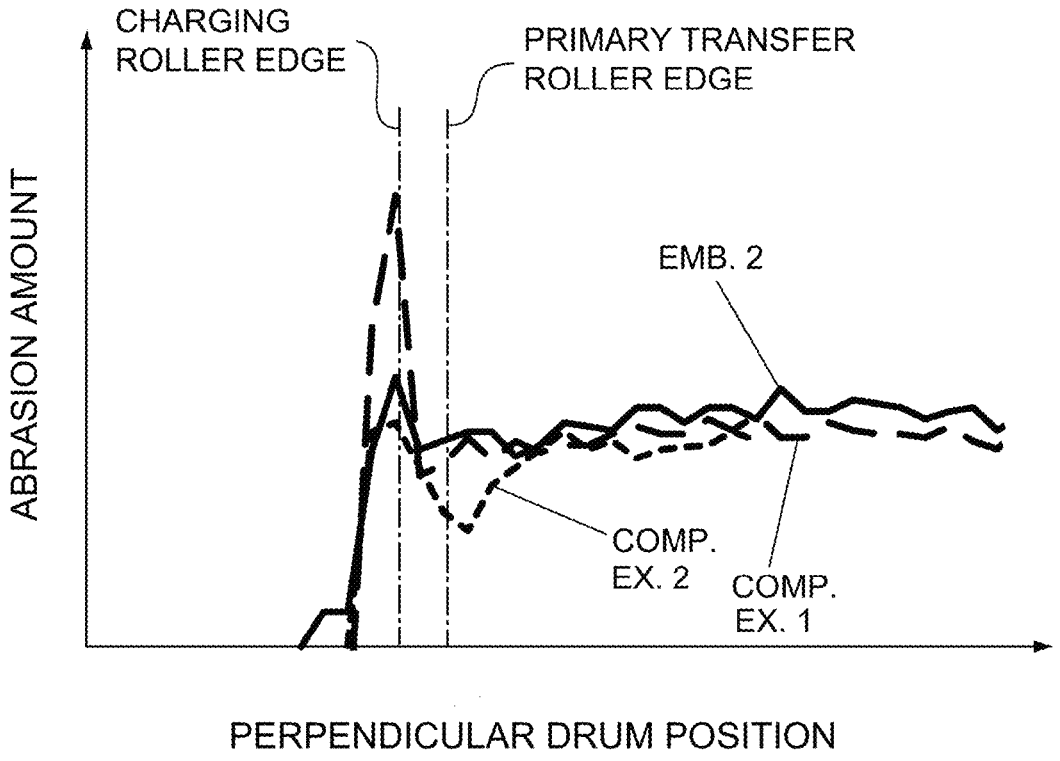
FIG. 12 is a graph showing an experimental result of an abrasion amount when the image forming apparatus effects interruption printing.

A result of a comparison experiment of an abrasion amount of the photosensitive layer when intermittent printing is effected will be described. In this embodiment, a constitution in which the image forming apparatus A is provided with the shielding members 100 by which the discharging light L emitted to the inside of the charging region including both end portions of the charging region and the outside of the transfer region with respect to the rotational axis direction R of the photosensitive drum 5 is "EMB. 2" (this embodiment). Further, a constitution in which the shielding members 100 are not provided is "COMP. EX. 1" (Comparison Example 1). Further, as shown in FIG. 11, a constitution in which the discharging light L emitted to the inside of the transfer region with respect to the rotational axis direction R of the photosensitive drum 5 is shielded by the shielding members 100 is "COMP. EX. 2" (Comparison Example 2).

The experiment was conducted, in an experimental environment of 15.0° C. and 10% RH as an experimental condition, after the image forming apparatus was left standing for one day and was adapted to the experimental environment and then printing on 10000 sheets was effected. In the experiment, a lateral line recording image of 2% in image ratio was intermittently formed every two sheets and was printed on 10000 sheets. The abrasion amount of the photosensitive layer was calculated from a difference between a surface layer thickness of the photosensitive layer at an initial stage of the experiment and that after the printing of 10000 sheets.

As a result, as shown in FIG. 6, in the constitution of "COMP. EX. 1", the photosensitive layer was largely abraded in the neighborhood of the charging roller 6, with the result that local abrasion of the photosensitive layer generated. This is because the shielding members 100 are not provided and therefore strong electric discharge generated. In such a state, when the image formation is continued for a long term, the leak image generates. A direction perpendicular to the rotational direction of the photosensitive drum is a direction parallel to the rotational axis direction.

In the constitution in "COMP. EX. 2", by providing the shielding members 100, the local abrasion of the photosensitive drum in the neighborhood of the end portions of the charging roller 6 was eliminated. However, the discharging light L emitted to the inside of the transfer region is shielded by the shielding members 100, and therefore a region where the abrasion amount of the photosensitive layer was small partly generated in the transfer region. In such a state, when the image formation is continued for a long term, accuracy of the ATVC lowers.

On the other hand, in the constitution of "EMB. 2" (this embodiment), the local abrasion of the photosensitive layer in the neighborhood of the end portions of the charging roller 6 was eliminated. In addition, in the transfer region, the abrasion amount of the photosensitive layer was substantially uniform. Accordingly, even in the case where the image formation is continued for a long term, it is possible to not only prevent the generation of the leak image but also effect the ATVC with high accuracy.

In this embodiment, when a degree of uniformity in abrasion amount of the photosensitive layer of the photosensitive drum 5 in the transfer region is a certain level at which the ATVC with high accuracy is executable, a constitution in which a part of the discharging light L emitted to the inside of the transfer region is shielded by the shielding members 100 may also be employed. In this embodiment, the shielding members 100 may also shield at least a part of the discharging light L emitted from the second light sources 20*b* to the transfer region Wb. Even in such a constitution, the transfer region Wb is principally irradiated with the discharging light L emitted from the first light sources 20*a*, and therefore in the transfer region Wb, the degree of uniformity in abrasion amount of the photosensitive layer of the photosensitive drum 5 can be made not less than the certain level at which the ATVC with high accuracy is executable.

In this embodiment, the pre-exposure device 2 was provided in the main assembly of the image forming apparatus A, but the present invention is not limited thereto. A constitution in which the pre-exposure device 2 is provided in the process cartridge 4 may also be employed. The position of the shielding member 100 is determined by a relative positional relationship with the position of the pre-exposure device 2, and therefore by providing the shielding member 100 and the pre-exposure device 2 in the process cartridge 4, the illuminating region of the discharging light L is easily regulated.

In this embodiment, the shielding members 100 were provided in the process cartridge 4, but the present invention is not limited thereto. A constitution in which the shielding members 100 are provided in the main assembly of the image forming apparatus A may also be employed. As a result, compared with the constitution in which the shielding members 100 are provided in the process cartridge 4 which is a consumable, a manufacturing cost can be lowered.

In this embodiment, the intermediary transfer type image forming apparatus capable of forming the color image was described as an example, but the present invention is not limited thereto. The present invention is also applicable to an image forming apparatus capable of forming a monochromatic image. In this case, a constitution in which the toner image is directly transferred, without using the intermediary transfer belt, at the transfer nip formed by the photosensitive drum and the transfer roller is employed. Accordingly, in this case, the inside of the transfer region refers to a region where the transfer roller and the photosensitive drum are in direct contact with each other or a region where the transfer roller and the photosensitive drum opposing the transfer roller contact the sheet.

The image forming apparatus A may also be a printer, a copying machine, a facsimile machine or a multi-function machine having a combination of functions of these machines. Further, the image forming apparatus A may also be an image forming apparatus in which a recording material carrying member is provided and toner images of respective colors are successively transferred superposedly onto a recording material carried on the recording material carrying member.

By the above-described constitution in this embodiment, the discharge is effected uniformly in the transfer region of the photosensitive drum, and therefore the potential difference does not generate in the transfer region immediately before the charging. Accordingly, during the charging, there is no difference in discharge amount in the transfer region, so that there is no difference in abrasion amount of the photosensitive drum surface. For this reason, even in the case where the photosensitive layer is abraded by long-term use, the abrasion amount is uniform and therefore the potential difference does not generate in the transfer region of the photosensitive drum after the charging. Accordingly, in the case where the ATVC is effected, the potential difference does not generate in a region where the current toward the photosensitive drum 5 side flows, and therefore it is possible to effect the ATVC with high accuracy.

The discharging light is shielded in the neighborhood of the both end portions of the charging roller, and therefore the potential difference between the both end portions of the charging roller and the photosensitive drum in the neighborhood thereof becomes small, so that the electric discharge can be suppressed. Accordingly, it is possible to prevent the local abrasion of the photosensitive layer of the photosensitive drum in the neighborhood of the end portions of the charging roller and thus to prevent the generation of the leak image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-055738 filed on Mar. 19, 2015, 2015-057118 filed on Mar. 20, 2015, 2016-027614 filed on Feb. 17, 2016, and 2016-027615 filed on Feb. 17, 2016, which are hereby incorporated by reference herein in their entirety.

What is claimed is:

1. An image forming apparatus for forming an image by transferring a toner image from a rotatable image bearing member onto a transfer receiving material, said image forming apparatus comprising:

a charging member for electrically charging the image bearing member;

a light source for emitting light with which a surface of the image bearing member is irradiated to remove an electric charge remaining on the surface of the image bearing member after transfer of the toner image, wherein a part of the light is reflected by a surface of a belt; and a light quantity lowering member for lowering a quantity of a reflection component of the light that has an optical path on a belt side with respect to a tangential line extending from a center of said light source to the surface of the image bearing member, wherein said light quantity lowering member is provided so that a lowering amount of the quantity of the reflection component of the light at each of end portions of a charging region where the surface of the image bearing member is charged by said charging member is greater than that at a portion inside the end portions with respect to a rotational axis direction of the image bearing member.

2. The image forming apparatus according to claim 1, wherein said light quantity lowering member is provided so as to project toward said belt with respect to the tangential line.

3. The image forming apparatus according to claim 1, wherein said light quantity lowering member is provided in contact with said belt.

4. The image forming apparatus according to claim 3, wherein said light quantity lowering member is a flexible member.

5. The image forming apparatus according to claim 1, wherein said belt is an intermediary transfer member onto which the toner image is primary-transferred from the image bearing member.

6. The image forming apparatus according to claim 1, wherein said light quantity lowering member is a member through which the light emitted from said light source does not pass.

7. The image forming apparatus according to claim 1, wherein when said light quantity lowering member is viewed in the rotational axis direction of the image bearing member, a portion closer to said belt than another portion is with respect to a direction perpendicular to direct light directly emitted from said light source to the image bearing member is closer to said light source, with respect to a direction parallel to the direct light, than said other portion.

8. The image forming apparatus according to claim 1, wherein when a surface potential of the image bearing member after charging in a region where an electrostatic latent image is formed on the image bearing member is 0% and the surface potential in another region is 100%, said light quantity lowering member lowers the light quantity of the light emitted from said light source so that the surface potential at each of the end portions of the charging region with respect to the rotational axis direction of the image bearing member is 50% or more after irradiation of the light emitted from said light source.

9. The image forming apparatus according to claim 1, wherein said light quantity lowering member lowers a light quantity of a direct component, of the light emitted from said light source, directly emitted to the image bearing member, and wherein said light quantity lowering member is provided so that a lowering amount of the direct component at each of the end portions of the charging region is greater than that at the portion inside the end portions with respect to the rotational axis direction of the image bearing member.

10. A cartridge detachably mountable to an image forming apparatus in which a toner image formed on a rotatable image bearing member is transferred onto a transfer receiving material, and a surface of the image bearing member is irradiated with light from a light source to remove an electric charge remaining on the surface of the image bearing member after transfer of the toner image, said apparatus including a belt contactable to the image bearing member, said cartridge comprising:

a light quantity lowering member for lowering a quantity of a reflection component of the light that has an optical path on a belt side with respect to a tangential line extending from a center of the light source to the surface of the image bearing member, wherein said light quantity lowering member is provided so that a lowering amount of the quantity of the reflection component of the light at each of end portions of a charging region where the surface of the image bearing member is charged by the charging member is greater than that at a portion inside the end portions with respect to a rotational axis direction of the image bearing member.

11. The cartridge according to claim 10, wherein said light quantity lowering member is provided so as to project toward said belt with respect to the tangential line.

12. The cartridge according to claim 10, wherein said belt is an intermediary transfer member onto which the toner image is primary-transferred from the image bearing member.

13. The cartridge according to claim 10, wherein said light quantity lowering member is a member through which the light emitted from said light source does not pass.

14. The cartridge according to claim 10, wherein when said light quantity lowering member is viewed in the rotational axis direction of the image bearing member, a portion closer to said belt than another portion is with respect to a direction perpendicular to direct light directly emitted from said light source to the image bearing member is closer to said light source, with respect to a direction parallel to the direct light, than said other portion.

15. The cartridge according to claim 10, wherein when a surface potential of the image bearing member after charging in a region where an electrostatic latent image is formed on the image bearing member is 0% and the surface potential in another region is 100%, said light quantity lowering member lowers the light quantity of the light emitted from said light source so that the surface potential at each of the end portions of the charging region with respect to the rotational axis direction of the image bearing member is 50% or more after irradiation of the light emitted from said light source.

16. The cartridge according to claim 10, wherein said light quantity lowering member lowers a light quantity of a direct component, of the light emitted from said light source, directly emitted to the image bearing member, and wherein said light quantity lowering member is provided so that a lowering amount of the direct component at each of the end portions of the charging region is greater than that at the portion inside the end portions with respect to the rotational axis direction of the image bearing member.

* * * * *